US005722902A

United States Patent [19]

Dupreé

[11] Patent Number: 5,722,902

[45] Date of Patent: Mar. 3, 1998

[54] METAL MOUNTING FRAME FOR BASKETBALL BACKBOARD AND METHOD OF INSTALLATION

[76] Inventor: Donovan G. Dupreé, 10663 Northbrook, Houston, Tex. 77043

[21] Appl. No.: 615,538

[22] Filed: Mar. 12, 1996

[51] Int. Cl.[6] ..... A63B 71/02

[52] U.S. Cl. ..... 473/483; 248/237

[58] Field of Search ..... 273/1.5 R; 248/237; 473/481, 483, 484

[56] References Cited

U.S. PATENT DOCUMENTS

| | | | |
|---|---|---|---|
| 511,721 | 12/1893 | Burk | 248/237 |
| 528,169 | 10/1894 | Kenison et al. | 248/237 |
| 590,872 | 9/1897 | Allen | 248/237 X |
| 590,949 | 9/1897 | Wilken . | |
| 808,989 | 1/1906 | Kingston | 248/237 |
| 1,650,324 | 11/1927 | Campbell . | |
| 1,864,457 | 6/1932 | Nelson | 248/237 |
| 2,446,093 | 7/1948 | Lambert . | |
| 2,623,794 | 12/1952 | Osten | 248/237 X |
| 3,108,803 | 10/1963 | Naideth . | |
| 3,414,262 | 12/1968 | Lounsbury . | |
| 4,085,762 | 4/1978 | O'Brian et al. . | |
| 4,342,374 | 8/1982 | Montana | 248/237 X |
| 4,613,136 | 9/1986 | Raba et al. . | |
| 4,790,541 | 12/1988 | Lin | 273/408 |
| 4,869,501 | 9/1989 | Anastasakis . | |
| 5,098,093 | 3/1992 | Dupreé . | |
| 5,318,148 | 6/1994 | Franco et al. | 248/237 X |

*Primary Examiner*—Paul E. Shapiro
*Attorney, Agent, or Firm*—Bush, Riddle, & Jackson, L.L.P.

[57] ABSTRACT

A metal mounting frame (10) has a pair of parallel frame portions (20, 22) connected to each other to support a basketball backboard (12). Each frame portion (20, 22) includes a lower upwardly facing channel-shaped base member (24), a downwardly facing channel-shaped upright member (26), and an adjustable diagonal bracing member (28) extending between members (24) and (26). In a flat collapsed position, upwardly facing channel-shaped base members (24) are received within downwardly facing channel-shaped upright members (26) and diagonal bracing members (28) are received in the space between the channel-shaped base members (24) and channel-shaped upright members (26). For erection of the mounting frame (10) from the flat collapsed position, upright members (26) are unfolded from base members (24) and the lower free ends of diagonal bracing members 28 are then secured to the extending free ends of base members (24). Telescoping diagonal portions (28A) and (28B) are secured to each other upon mounting of frame (10) on the roof and positioning of upright members (26) in a vertical direction.

1 Claim, 1 Drawing Sheet

FIG. 1
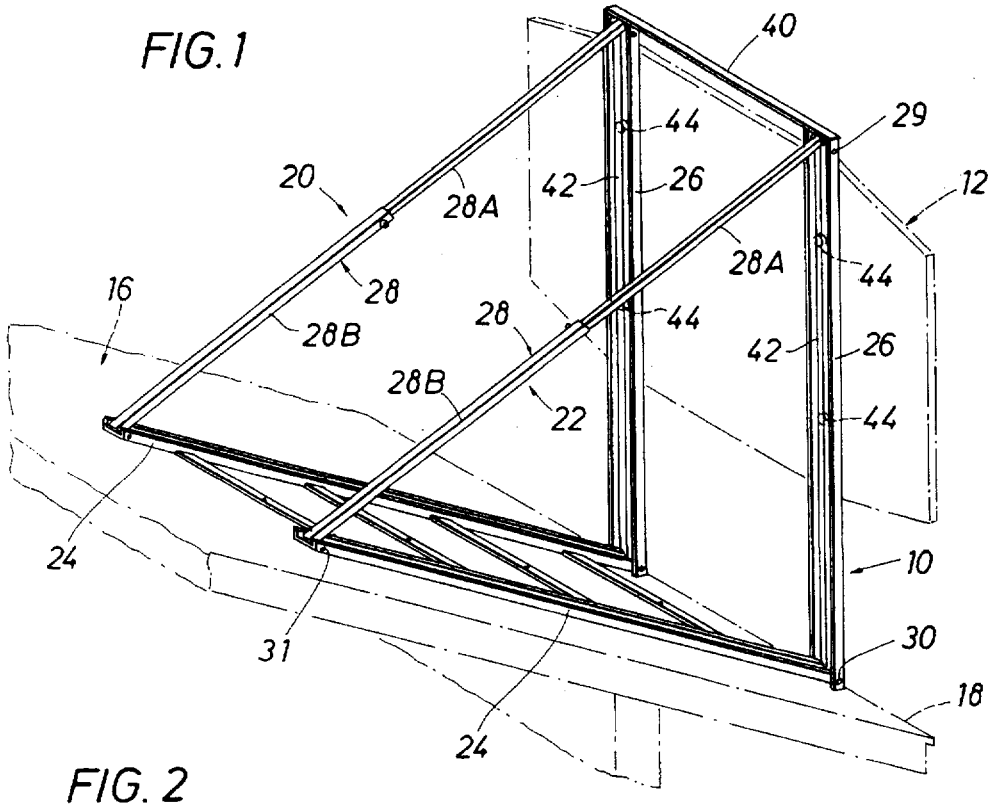
FIG. 2
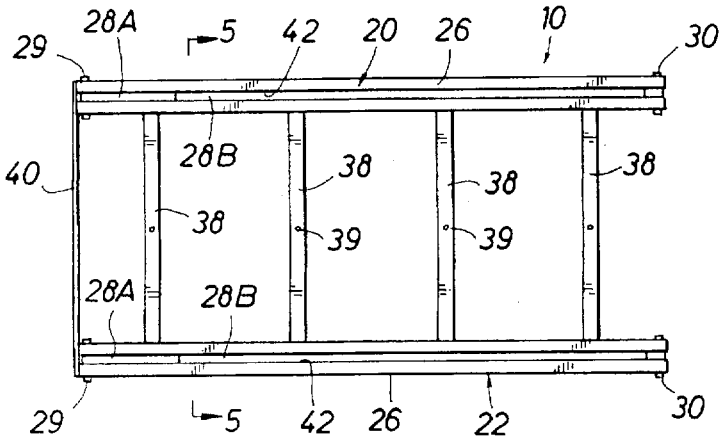
FIG. 3
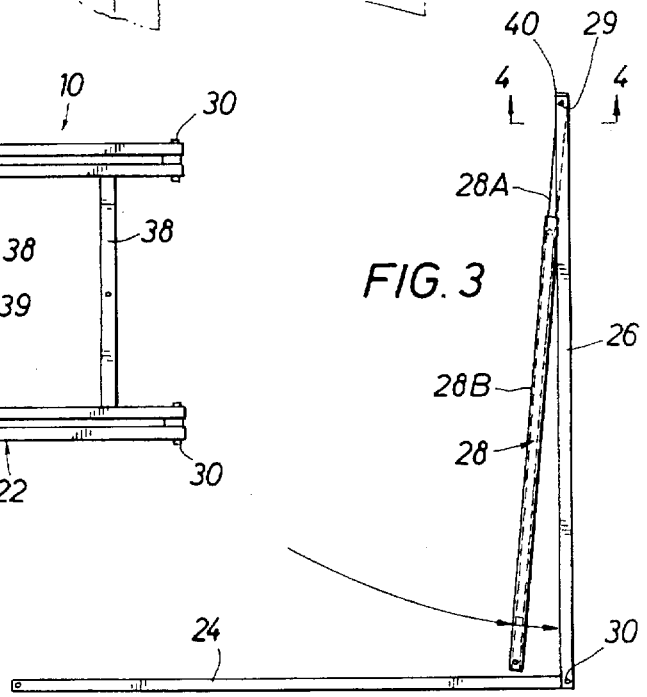
FIG. 4
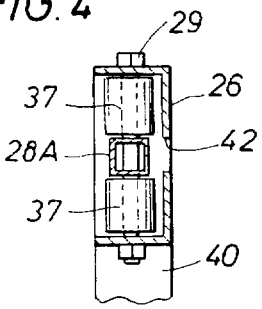
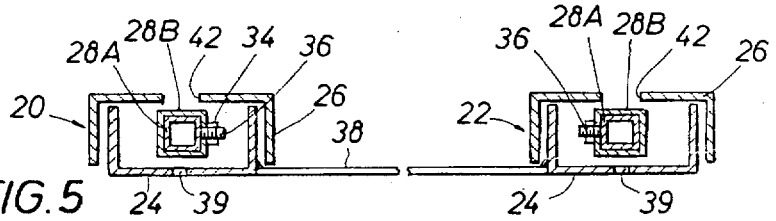
FIG. 5

METAL MOUNTING FRAME FOR BASKETBALL BACKBOARD AND METHOD OF INSTALLATION

FIELD OF THE INVENTION

This invention relates to a metal mounting frame for a basketball backboard and its method of installation, and more particularly to such a metal mounting frame and method of installing the frame on the roof of a garage or the like.

BACKGROUND OF THE INVENTION

U.S. Pat. No. 5,098,093 issued Mar. 24, 1992 concerns a wooden frame for a basketball backboard which includes two separate frame portions spaced from and not connected to each other. Each separate frame portion includes a base support member, a vertical upright member, and an adjustable diagonal bracing member, the members being foldable to a flat relation for storage or shipment of the frame. For installation on a roof, the separate frame portions are spaced from each other a precise distance and then secured to the roof. The backboard is then adjustably connected to the vertical upright members. Several installation steps are required for installation of the wooden mounting frame shown in U.S. Pat. No. 5,098,093.

U.S. Pat. No. 4,869,501 dated Sep. 26, 1989 shows a basketball backboard mounted on a collapsible flame having a diagonal member. However, the basketball stand has a base supported on the floor, and is not adapted for mounting on the sloping roof of a garage or the like. A slidable backboard support member secured to the backboard slides along the diagonal member for adjustment of the basket.

U.S. Pat. No. 3,108,803 dated Oct. 29, 1963 shows a basketball backboard support frame having a metal supporting frame for mounting on the roof of a building. The metal frame utilizes a plurality of L-shaped metal members which are bolted to each other upon installation to form a supporting frame. The individual L-shaped metal members are provided separately in a kit and are not connected to each other. The mounting frame is not adapted for folding to a collapsed flat compact structure of a uniform thickness for storage or shipment.

U.S. Pat. No. 3,414,262 dated Dec. 3, 1968 shows a mounting frame for a basketball backboard with the frame formed of tubular metal bars. The bars are not foldable into a flat collapsed frame of a minimal uniform height for storage or shipment.

SUMMARY OF THE INVENTION

The present invention is directed to an integral mounting frame for a basketball backboard adapted for mounting on the roof of a garage or the like. The integral metal mounting frame includes a pair of frame portions connected to each other by a plurality of spaced parallel metal strips secured between the frame portions. Each metal frame portion includes three members interfitting in a flat collapsed storage or transport position to provide a minimal height or profile. Thus, minimal space is required for storage or packaging for shipment.

Each frame portion has a channel-shaped base support member, a channel-shaped vertical upright member, and an adjustable diagonal member. When folded to a collapsed position, the channel-shaped base member and channel-shaped upright member interfit in a mating relation, and the diagonal member which comprises a pair of box-shaped telescoping portions is received in the space between the mating channel-shaped members in a compact relation to provide a minimal height when in a collapsed position. The integral metal mounting frame in collapsed position may be easily packaged for shipment and/or storage if desired. In the collapsed position, the telescoping diagonal bracing members are hinged to the upright members at their upper ends, and the lower ends are free.

For erection or installation of the metal mounting frame from a collapsed position, the frame members are unfolded to form a triangular frame. The free lower ends of the telescoping diagonal members are aligned with the free ends of the base members and are fastened to the extending free ends of the base members by suitable nut and bolt combinations. Then, the frame is secured to the roof by fastening of the base members and connecting strips between the base members to the roof by suitable fasteners, such as lag bolts. Next, the upright members are adjusted to a vertical position to receive the basketball backboard with the telescoping bracing members movable to the position in which the upright members are in vertical relation. Then, suitable fasteners secure the telescoping portions to each other to maintain the upright members in a vertical relation for attachment to the backboard. The mounted frame is thus secured to the roof and mounted with a backboard in a minimum of time. The basketball backboard has mounting holes spaced horizontally a standard distance (17½ inches) and is mounted on the vertical upright members at a desired height.

Other features and advantages of the invention will become more apparent after referring to the following specification and drawings.

BRIEF DESCRIPTION OF THE DRAWINGS

FIG. 1 is a perspective of a metal mounting frame for mounting a basketball backboard on a sloping roof of a building with the frame shown in an installed position on a sloping roof, FIG. 2 is a top plan of the support frame in a collapsed flat position with the lower base members being received by the upper upright members to provide a minimum collapsed height for storage or transport;

FIG. 3 is a side elevation of a partially erected position of the mounting frame when unfolded from collapsed position for mounting on the roof;

FIG. 4 is an enlarged section taken generally along line 4—4 of FIG. 3 illustrating the pivotal connection of the diagonal member to the upright member; and FIG. 5 is an enlarged section along line 5—5 of FIG. 2 showing the interfitting relation of the collapsed members in the collapsed flat position of the metal frame.

DESCRIPTION OF THE INVENTION

Referring to the drawings, a metal mounting or support frame is generally indicated at 10 for supporting a basketball backboard 12 having a hoop secured thereto on a sloping roof generally designated 16 of a building, such as a garage adjacent a hard surfaced driveway. Backboard 12 is positioned at a location generally above the lower outer edge 19 of roof 16.

Frame 10 includes a pair of similar parallel frame portions 20 and 22 connected to each other for supporting backboard 12. Each frame portion 20 and 22 includes in erect position a lower upwardly facing channel-shaped base member 24, a downwardly facing channel-shaped upright member 26, and an adjustable diagonal bracing member 28 extending between members 24 and 26. Members 24, 26, and 28 are foldably connected to each other by suitable nut and bolt combinations 29, 30, and 31 which form hinges. Diagonal member 28 includes upper and lower telescoping diagonal portions 28A and 28B which are adjustable to vary the length of diagonal member 28 and to permit positioning of upright members 26 in a vertical relation. Lower diagonal portion 28B is of a hollow rectangular cross section and receives upper diagonal portion 28A of a rectangular cross section in telescoping relation. Each lower diagonal portion 28B has an internally threaded opening 34 therein and a suitable set screw or bolt 36 engaging opening 34 may be tightened against diagonal portion 28A to secure diagonal portions 28A and 28B at the vertical position of upright members 26 when frame 10 is in installed position as shown in FIG. 1. As shown in FIG. 4, a pair of spacer rollers 37 are mounted on nut and bolt combination 29 to position upper diagonal portion 28A.

A plurality of parallel lower metal strips 38 extend between and are secured to base members 24 of frame portions 20 and 22. Openings 39 are provided in metal strips 38 and base members 24 to receive suitable fasteners for mounting frame 10 on roof 16. An upper connecting strip 40 extends between and is secured to the upper ends of upright members 26. Upright channel-shaped member 26 formed from a pair of angles has a longitudinal slot 42 extending in a vertical direction in the erect position of frame 10 as shown in FIG. 1. Basketball backboard 12 has pairs of openings therein spaced a standard horizontal distance (17½ inches) from each other. Nut and bolt combinations 44 with suitable washers are received within the openings and fit within slots 42 for tightening of nut and bolt combinations 44 at the desired height of backboard 12. Other types of fasteners may be utilized, if desired, for mounting of backboard 12 on upright members 26.

Frame 10 is shown in FIGS. 2 and 5 in a collapsed flat position in which it may be packaged for storage or for transport to a suitable site for installation or erection. FIG. 3 shows frame 10 at an intermediate step prior to folding of upright members 26 and diagonal members 28 downwardly about pivot 30 onto lower base members 24. After folding to the collapsed position, lower upwardly facing channel-shaped base member 24 is received within downwardly facing channel-shaped upright member 26 and diagonal bracing member 28 is positioned between members 24 and 26. Nut and bolt combinations 31 which connect the ends of diagonal members 28 and base members 24 have been removed from aligned openings in diagonal members 28 and base members 24 as shown in FIG. 3 to permit collapsing of frame 10 to the position of FIGS. 2 and 5. Also, set screws 36 on diagonal portions 28B are loosened to permit relative telescoping movement of diagonal portions 28A and 28B. Thus, it is only necessary to loosen set screws 36 and remove nut and bolt combination 31 in order to collapse frame 10 to the flat position shown in FIG. 2 from an erect position. Upright members 26 are of a length greater than the length of lower base members 24. Thus, upper connecting strip 40 is positioned beyond the ends of base members 24 is collapsed position to permit interesting of channel-shaped members 24 and 26 as shown in FIG. 5.

For installation or erection of frame 10 from the collapsed position, upright members 26 are folded upwardly about hinges 30 and openings in the free ends of diagonal members 28 are aligned with openings in the free extending ends of base members 24. Nut and bolt combinations 31 are then connected to the aligned openings in members 24 and 28 to form parallel frame portions 20 and 22 of a generally triangular configuration. In this position, frame 10 is positioned at a desired location on roof 16 of a garage or the like with the front of frame 10 generally flush with the cave or gutters shown at 18. A suitable drill may be utilized to drill openings in the roof at the location of openings 39 in strips 38 and base members 24. Then, fasteners, such as lag screws and suitable washers, may be mounted within openings 39 to secure frame 10 to the roof. After frame 10 is secured to the roof, upright members 26 with set screws 36 loosened are positioned at a vertical relation by use of a suitable level. In this position, set screws 36 are tightened to secure diagonal portions 28A and 28B to each other for maintaining the vertical relation of upright members 26. Next, basketball backboard 12 may be positioned on upright members 26 at a desired height with openings in backboard 12 aligned with slots 42. Then, nut and bolt combinations 44 are positioned and tightened within the aligned openings and slots 42.

From the above, it is apparent that mounting frame 10 shown in a flat collapsed position in FIGS. 2 and 5 is of a minimum height for storage or transport. Downwardly facing channel-shaped upright members 26 receive upwardly facing channel-shaped base members 24 and bracing members 28 are positioned between the channel-shaped base members 24 and 26 thereby utilizing a minimum space in the collapsed position. When unfolded from the collapsed position, mounting frame 10 may be easily erected by first securing the lower free ends of diagonal members 28 to the extending free ends of base members 24 by nut and bolt combinations 31. The only other adjustment or connection required after securement of mounting frame 10 to the roof is the tightening of set screws 36 on diagonal members 28 when upright members 26 are positioned at a vertical relation thereby to maintain upright members 26 in the vertical relation. Frame 10 is easily adapted for use with roofs having varying slopes.

While a preferred embodiment of the present invention has been illustrated in detail, it is apparent that modifications and adaptations of the preferred embodiment will occur to those skilled in the art. However, it is to be expressly understood that such modifications and adaptations are in the spirit and scope of the present invention as set forth in the following claims.

What is claimed is:

1. A method for installing a metal mounting frame for a basketball backboard on the inclined roof of a garage or the like from a collapsed folded position of the metal mounting frame, the metal mounting frame having a pair of metal parallel frame portions connected to each other and folded simultaneously between collapsed and erect positions, each frame portion including an upwardly facing channel-shaped base member, and a downwardly facing channel-shaped upright member for supporting said backboard hinged to said upwardly facing channel-shaped base member; a pair of adjustable diagonal bracing members, each including a pair of slidably connected telescoping portions comprising an upper telescoping portion hinged to said upright member and a lower telescoping portion disconnected from said base member in the collapsed flat position so that upon erection of said mounting frame from the collapsed flat portion said telescoping portions are extended until said lower telescoping portion is accurately aligned with said base member for securement;

said upwardly facing channel shaped base member and said downwardly facing channel-shaped upright member interfitting in a collapsed position to provide a minimum height to said mounting frame when folded to a collapsed position; and adjustable means to secure said upper and lower telescoping members to each other when said upright member is positioned in vertical relation; said method for installing said frame from said collapsed position comprising the following steps:

unfolding the frame;

extending the telescoping portions of the diagonal members to align the free ends of said diagonal members with free ends of said base members;

connecting the free ends of said diagonal members and said base members to each other after alignment to provide an erect mounting frame;

then securing the erect metal mounting frame to the roof;

adjusting the upright members to a vertical position for receiving the basketball backboard by moving the telescoping portions relative to each other;

fastening said telescoping portions to each other with said adjustable fastening means to maintain the upright members in a vertical relation for attachment of said backboard; and mounting a basketball backboard on said upright members at a predetermined height.

* * * * *

UNITED STATES PATENT AND TRADEMARK OFFICE

CERTIFICATE OF CORRECTION

PATENT NO. : 5,722,902

DATED : Mar. 3, 1998

INVENTOR(S) : Donovan G. Dupre'

It is certified that error appears in the above-identified patent and that said Letters Patent is hereby corrected as shown below:

On title page, item [76]

The correct spelling of the inventor's name is:

Donovan G. Dupre'

Item [19] change, "Dupreé" to —Dupre'—

Signed and Sealed this

Sixteenth Day of June, 1998

Bruce Lehman

*Attest:*

BRUCE LEHMAN

*Attesting Officer*

*Commissioner of Patents and Trademarks*